US010119205B2

(12) United States Patent
Klein et al.

(10) Patent No.: US 10,119,205 B2
(45) Date of Patent: Nov. 6, 2018

(54) COMPOSITE REINFORCING INSERT AND MANUFACTURING METHOD

(71) Applicants: SAFRAN AIRCRAFT ENGINES, Paris (FR); FSP-ONE, Pont-de-Cheruy (FR)

(72) Inventors: Gilles Charles Casimir Klein, Méry sur Oise (FR); Gérald Sanchez, Dingy St Clair (FR)

(73) Assignees: SAFRAN AIRCRAFT ENGINES, Paris (FR); FSP-ONE, Pont-de-Cheruy (FR)

( * ) Notice: Subject to any disclaimer, the term of this patent is extended or adjusted under 35 U.S.C. 154(b) by 367 days.

(21) Appl. No.: 14/912,694

(22) PCT Filed: Aug. 19, 2014

(86) PCT No.: PCT/FR2014/052100

§ 371 (c)(1),
(2) Date: Feb. 18, 2016

(87) PCT Pub. No.: WO2015/025107

PCT Pub. Date: Feb. 26, 2015

(65) Prior Publication Data

US 2016/0201260 A1 Jul. 14, 2016

(30) Foreign Application Priority Data

Aug. 21, 2013 (FR) ..... 13 58105

(51) Int. Cl.
*D02G 3/38* (2006.01)
*D02G 3/12* (2006.01)
(Continued)

(52) U.S. Cl.
CPC ..... *D02G 3/38* (2013.01); *B22F 5/04* (2013.01); *C22C 47/064* (2013.01); *C22C 49/06* (2013.01);
(Continued)

(58) Field of Classification Search
CPC ..... D02G 3/12; D02G 3/16; D02G 3/38
See application file for complete search history.

(56) References Cited

U.S. PATENT DOCUMENTS 4,375,779 A * 3/1983 Fischer ..... D02G 3/16 428/366
4,430,851 A * 2/1984 Sundet ..... D02G 3/36 57/210
(Continued)

FOREIGN PATENT DOCUMENTS

EP 0 931 846 A1 7/1999
EP 1 995 342 A1 11/2008
(Continued)

OTHER PUBLICATIONS

International Search Report as issued in International Patent Application No. PCT/FR2014/052100, dated Nov. 24, 2014.

*Primary Examiner* — Shaun R Hurley
(74) *Attorney, Agent, or Firm* — Pillsbury Winthrop Shaw Pittman LLP

(57) ABSTRACT

A composite reinforcement insert includes a strand formed by a central fiber made of ceramic material surrounded by filaments of metal alloy helically wound around the central fiber, and a metal reinforcement layer covering the strand.

11 Claims, 2 Drawing Sheets

(51) Int. Cl.

| | |
|---|---|
| ***D07B 1/06*** | (2006.01) |
| ***B22F 5/04*** | (2006.01) |
| ***C22C 47/06*** | (2006.01) |
| ***C22C 49/06*** | (2006.01) |
| ***C22C 49/08*** | (2006.01) |
| ***C22C 49/11*** | (2006.01) |

(52) U.S. Cl.
CPC ..... *C22C 49/08* (2013.01); *C22C 49/11* (2013.01); *D02G 3/12* (2013.01); *D07B 1/0633* (2013.01)

(56) References Cited

U.S. PATENT DOCUMENTS 4,576,081 A * 3/1986 Felthuis ..... C10B 25/16 57/210
5,711,143 A * 1/1998 Munakata ..... H01B 5/104 57/215
6,174,570 B1 * 1/2001 Dambrine ..... C03C 25/16 427/431
7,100,352 B2 * 9/2006 Robins ..... D02G 3/38 57/210
8,084,099 B2 * 12/2011 Franchet ..... C04B 41/009 427/431
2003/0134247 A1 * 7/2003 Dewaegheneire ..... D02G 3/12 431/326
2005/0155336 A1 * 7/2005 Robins ..... D02G 3/38 57/210
2005/0279074 A1 * 12/2005 Johnson ..... H01B 5/105 57/212
2007/0110913 A1 * 5/2007 Franchet ..... C04B 41/009 427/430.1
2011/0088618 A1 * 4/2011 Franchet ..... C04B 41/009 118/600
2012/0064254 A1 * 3/2012 Franchet ..... C04B 41/009 427/431

FOREIGN PATENT DOCUMENTS

FR 2 684 578 A1 6/1993
FR 2 962 483 A1 1/2012

* cited by examiner

COMPOSITE REINFORCING INSERT AND MANUFACTURING METHOD

CROSS-REFERENCE TO RELATED APPLICATIONS

This is the U.S. National Stage of PCT/FR2014/052100, filed Aug. 19, 2014, which in turn claims priority to French Patent Application No. 1358105, filed Aug. 21, 2013, the entire contents of all applications are incorporated herein by reference in their entireties.

TECHNICAL DOMAIN

This invention relates to a reinforcing insert, preferably for a turbomachine part, and a method of manufacturing such a reinforcing insert.

STATE OF PRIOR ART

A permanent objective particularly in the aeronautical domain is to optimise the strength of parts for minimum mass and size. Thus, some parts may now include a reinforcing insert made of a composite material with a metallic matrix. Such a composite material usually comprises a metal alloy matrix, for example made of a titanium Ti, Nickel Ni or Aluminium Al alloy, in which fibres are placed, for example silicon carbide SiC ceramic fibres. Such fibres have a much better tension strength than titanium (typically 4000 MPa compared with 1000 MPa) and are typically three times stiffer. Therefore, forces are resisted by the fibres, the metal alloy matrix transmitting loads between fibres, performing a binder function with the remainder of the part, and a function to protect and separate the fibres that must not come into contact with each other. Ceramic fibres are also strong but fragile and have to be protected by metal.

These composite materials may be used for manufacturing disks, shafts, actuator bodies, casings, spacers, as reinforcement for monolithic parts such as blades, etc. They can also be used in applications in other fields in which a 3D force field is applied to one part, for example a pressure vessel such as a barrel or a fluid tank under pressure.

In order to obtain such a reinforcing insert made of a composite material, the first step is to form "coated wires" comprising reinforcement composed of a ceramic fibre coated with a metallic casing. The metal coating makes the wire stiffer but improves its toughness, which is useful for handling.

In prior art, coating of silicon carbide (SiC) fibres is often done using an electron beam physical vapour deposition (EBPVC) method. However, this method is not very cost effective in terms of efficiency. Furthermore, the coating method takes a long time, because the deposition rate is of the order of one meter per minute.

Prior art also discloses a direct method of coating the SiC fibre in levitation in a melting metal bath. For example, document EP 0931846 discloses such a coating method. This document discloses that the liquid metal can be maintained in levitation in an appropriate crucible so as to at least partially eliminate contact with the walls of the crucible, at an appropriate temperature. Levitation is achieved by electromagnetic means surrounding the crucible. The ceramic fibre held tensioned by preemption means, is drawn through the metal bath. The rate of transfer of the fibre in the metal bath is defined as a function of the required thickness of the metal on the fibre. This method is faster than the previous method, but it creates an offset fibre. Furthermore, this method makes it difficult to adjust the ratio between the percentage of SiC fibre and the percentage of metal matrix. Furthermore, destabilisations can occur in inserts manufactured according to this method.

PRESENTATION OF THE INVENTION

The invention aims to overcome the disadvantages of the state of the art by disclosing a reinforcing insert with reinforced strength and for which the composition can be chosen.

To achieve this, a first aspect of the invention relates to a composite reinforcing insert, preferably for a turbomachine, comprising:

- a strand consisting of a central fibre made of a ceramic material surrounded by metal alloy outer filaments wound spirally around the central fibre;
- a metal reinforcing layer coating the strand.

A "strand" is an assembly for which the filaments or fibres are arranged in concentric layers around a central filament or fibre.

Thus, unlike reinforcing inserts according to prior art in which the reinforcing layer is deposited directly on the central fibre, the invention discloses that metal alloy fibres can firstly be wound around the central fibre, and the assembly obtained can then be coated with a metallic reinforcing layer. The reinforcing insert thus obtained has improved stiffness. It also has the advantage that its central fibre is centred relative to the metal part that surrounds it. Furthermore, such a reinforcing insert is particularly advantageous because it is easy to choose the ratio between the percentage of ceramic material and the percentage of metal alloy.

The reinforcing insert according to the invention may also have one or several of the following characteristics alone or possibly combined when technically possible.

According to different embodiments, the strand may comprise N filaments made of metal alloy, where N is greater than or equal to 6. N is preferably equal to 7, 19 or 37. The diameter of the metallic filaments and their number N are determined such that the insert has a chosen number Vf. The number Vf corresponds to the ratio between the area of the ceramic fibre and the metal alloy filaments surrounding it. When the strand comprises 6 metal alloy filaments, these filaments are preferably arranged so as to form a single layer around the central fibre. Vf is then equal to 1/7 or 14.3%. When constructions with Vf less than 14% are chosen, the strand comprises more than 18 or 19 filaments around the central fibre and these filaments are preferably arranged so as to form several concentric layers around the central fibre.

The central fibre is preferably made of silicon carbide, which has good mechanical properties.

Advantageously, the filaments are made from a metal alloy based on titanium, nickel or aluminium such that the reinforcing insert has a good mechanical strength/weight ratio.

The metal reinforcing layer is preferably made from the same basic metallic material as the metal alloy forming the filaments.

A second aspect of the invention also relates to a method of making a reinforcing insert, preferably intended for use in a turbomachine, from a central ceramic fibre, the method including the following steps:

(a) Stranding of metal alloy filaments around the central fibre so as to form a strand;

(c) Coating of the strand with a protective metal layer.

Such a method is simple and fast, and it can be used to obtain reinforcing inserts for which the composition may be chosen. Furthermore, the ceramic fibre of the insert thus made is centred.

The method may also include a step (b) to fix filaments by spot welds. This step may be done by laser or by electron beam. However, this fixing step is not essential if the strand has mechanical strength without the filaments swelling.

The coating step preferably includes a step in which the strand is dipped into a liquid metal bath in levitation fusion.

The liquid metal in levitation fusion preferably contains a filler with the same material as the basic material of the filaments.

The method may also include a step between steps (b) and (c) in which the strand is coated with an oxidation-resistant protective layer. This protective layer is particularly useful when the metal alloy of the filaments is sensitive to oxidation. This is the case for example when the filaments are made from an aluminium alloy. The strand can then be coated with a protective layer, preferably a copper nanolayer. This protective layer then disappears when the strand enters the liquid metal bath.

Another aspect of the invention also relates to a metal part for a turbomachine, comprising an insert according to the first aspect of the invention or made using a method according to the second aspect of the invention.

The invention also relates to a method of making a metal part for a turbomachine comprising the following steps:

Installation of a reinforcing insert by winding according to the first aspect of the invention or obtained by a method according to the second aspect of the invention around the turbomachine part;

Compaction of the turbomachine part by hot isostatic compression.

BRIEF DESCRIPTION OF THE FIGURES

Other characteristics and advantages of the invention will become clear after reading the detailed description given with reference to the appended figures that illustrate.

Identical or similar elements are identified by identical references on all figures, to improve clarity.

DETAILED DESCRIPTION OF AT LEAST ONE EMBODIMENT

A method of making a reinforcing insert according to one embodiment of the invention is described with reference to FIGS. 1 to 4. The reinforcing insert is made from a ceramic central fibre 1. This central fibre 1 is made from silicon carbide. The method includes a first step (a) to make a strand by winding metal alloy filaments 2 around the central fibre 1. The filaments are preferably made from a metal alloy based on titanium, nickel or aluminium. The filaments are wound spirally around the central fibre so as to form a spiral around the central fibre. Depending on the ratio Vf, the strand may comprise more or less filaments 2. The number Vf is defined as the ratio between the areas of the central fibre and the metal filaments. For example, a 140 μm diameter central fibre 1 has a cross-section of 15400 $\mu m^2$. A strand with ten 70 μm diameter filaments has 10 cross-sections of 3850 $\mu m^2$ giving a total of 38500+15400=53900 $\mu m^2$. Therefore, the area ratio Vf is equal to 15400×53900×100=29%.

The strand usually comprises N filaments where N is greater than or equal to 6. The filaments 2 are arranged in concentric layers around central fibre 1. The diameter of the central fibre 1 and the diameter of filaments 2 may vary as a function of the required ratio Vf between the percentage of silicon carbide fibre and the percentage of strand material. The dimensional relations are:

$$\sin(180°/N)=RS/(R1+R2)\quad Vf=R1^{\wedge 2}/(R1^{\wedge 2}+N*R2^{\wedge 2})$$

where R1=radius of the ceramic fibre, R2 radius of the metal filament

N=number of metal filaments

Figure 1:
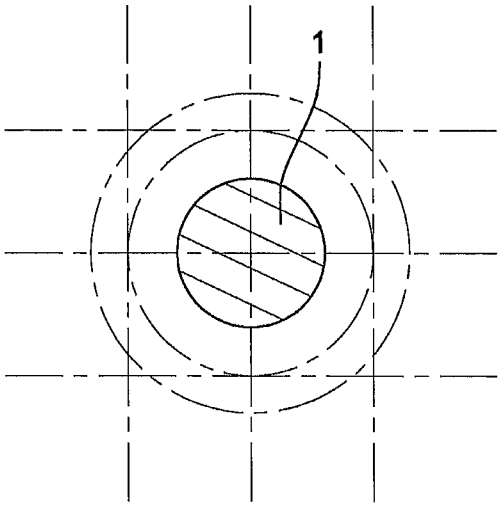
FIG. 1, a sectional view of a ceramic filament.
Figure 2:
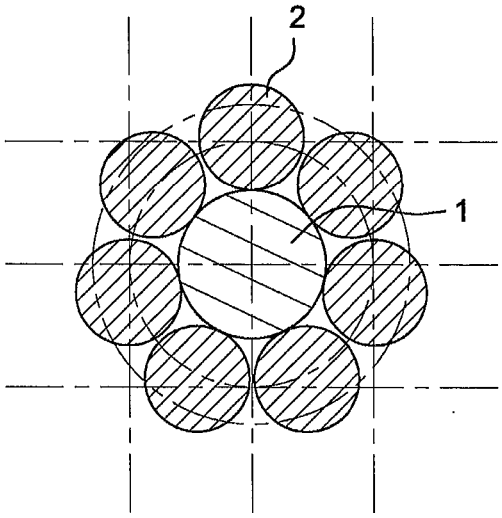
FIG. 2, a sectional view of a ceramic fibre surrounded by metal alloy filaments.
Figure 3:
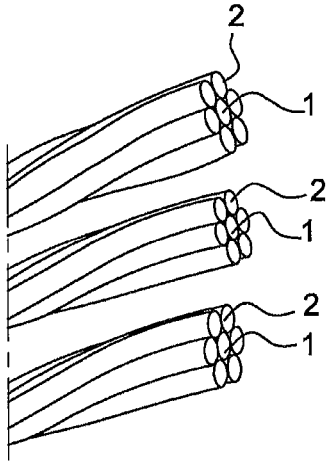
FIG. 3, a perspective view of three strands.
Figure 4:
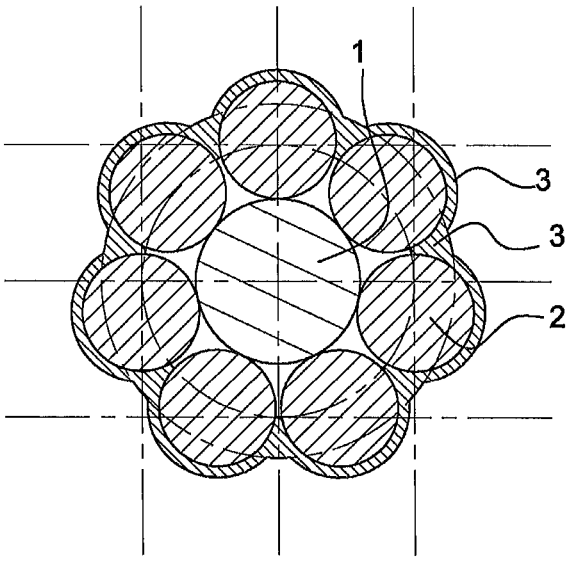
FIG. 4, a strand coated with a reinforcing layer.
Figure 5:
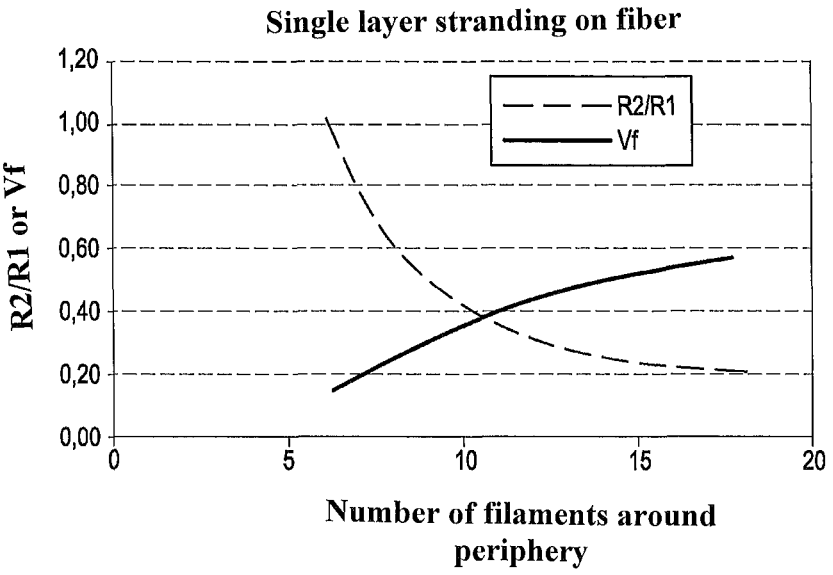
FIG. 5 shows the variation of the ratio of the radius of metal filaments and the radius of the fibre, and the Vf obtained as a function of the number of filaments for single layer constructions.

The variation of the number Vf as a function of the number of filaments in the case of single layer stranding is shown in FIG. 5, together with the variation of the ratio R2/R1 as a function of the number of filaments around the periphery.

For example, a 140 μm diameter silicon carbide fibre surrounded by seven 107 μm diameter filaments and coated with a 3 μm protective layer, has a percentage of silicon carbide SiC fibre equal to 20%.

During the stranding operation of metal alloy filaments around the central fibre 1, it is essential that the central fibre should be free to move without generating any radii of curvature less than 20 mm to avoid damaging the central fibre. To achieve this, the pulleys used to wind the central fibre during the stranding operation must be sufficiently large to avoid generating radii of curvature in the central fibre less than 20 mm.

If the strand is subject to swelling phenomena around the central fibre, then small weld spots of the filaments may be made in line with the stranding machine. A laser welding or electron beam technique can be used.

Moreover, when the filaments 2 are made from metal alloys sensitive to oxidation, the method may include a step (c) in which the strand is coated with a protective layer. For example, when the metal alloy used for the filaments 2 is based on aluminium, the protective layer may be a copper nanolayer. This protective layer disappears during the next step.

The method then includes a step (c) in which the strand is coated with a metal reinforcing layer 3. To achieve this, the strand is dipped into a liquid metal bath in levitation fusion with a filler of the same material as the filaments wound spirally around the central fibre 1. Thus, when the filaments 2 are made from a titanium-based alloy, the filler of the liquid metal bath preferably contains titanium. Similarly, when the filaments 2 are made from an aluminium-based metal alloy, the filler preferably contains aluminium. Strand coating methods using a liquid metal bath are known in prior art. For example, such methods are described in documents EP 0 931 846 or EP 1 995 342. The filaments 2 are not entirely remelted during the coating step. When this coating step (c) is finished, the strand is coated with a metal reinforcing layer 3. This reinforcing layer 3 is continuous.

The method then comprises a solidification step of the reinforcing insert, during which the reinforcing insert becomes rigid.

The result obtained is thus a reinforcing insert according to one embodiment of the invention comprising:

a strand comprising:

a ceramic central fibre 1;

metal alloy filaments 2 surrounding the central fibre 1 so as to form a spiral around the central fibre;

a metal alloy reinforcing layer 3 coating the strand.

The reinforcing insert thus obtained is easy to manufacture and is very strong. Furthermore, its composition can easily be modified.

The reinforcing insert thus obtained can then be used to reinforce parts, particularly in the aeronautic field. To achieve this, the reinforcing insert can subsequently be formed by winding around a part for a turbomachine, and particularly around a turbomachine casing or a disk. The reinforcing insert is placed in the part to be reinforced. The assembly thus obtained can then be compacted by hot isostatic compression. The result is a fully compact composite part.

Naturally, the invention is not limited to the embodiments described with reference to the figures, and variants could be envisaged without going outside the scope of the invention.

The invention claimed is:

1. A composite reinforcing insert comprising:

a strand consisting of a central fibre made of a ceramic material surrounded by metal alloy filaments wound spirally around the central fibre, and a metal reinforcing layer coating the strand.

2. The composite reinforcing insert according to claim 1, wherein the strand comprises N filaments, where N is greater than or equal to 6.

3. The composite reinforcing insert according to claim 1, wherein the central fibre is made of silicon carbide.

4. The composite reinforcing insert according to claim 1, wherein the filaments are made of an alloy based on titanium, nickel or aluminium.

5. The composite reinforcing insert according to claim 1, wherein the reinforcing layer is made from the same material as a basic material forming the filaments.

6. A turbomachine part comprising a composite reinforcing insert including a strand consisting of a central fibre made of a ceramic material surrounded by metal alloy filaments wound spirally around the central fibre, and a metal reinforcing layer coating the strand.

7. A method of making a reinforcing insert from a central ceramic fibre, the method comprising:

stranding metal alloy filaments around the central fibre so as to form a strand, and coating the strand with a protective metal layer.

8. The method according to claim 7, wherein the coating includes dipping the strand into a liquid metal bath in levitation fusion, the liquid metal in levitation fusion containing a filler with the same material as a basic material of the filaments.

9. The method according to claim 7, further comprising fixing the filaments by spot welds.

10. The method according to claim 7, further comprising, between the stranding and the coating, coating the strand with an oxidation-resistant protective layer.

11. The composite reinforcing insert according to claim 2, wherein N is equal to 7, 19 or 37.

* * * * *